United States Patent [19]

Ahrens

[11] Patent Number: 4,789,021

[45] **Date of Patent: * Dec. 6, 1988**

[54] SHORT MOLD FOR CONTINUOUS CASTING

[75] Inventor: Max Ahrens, Irvine, Calif.

[73] Assignee: Steel Casting Engineering, Ltd., Orange, Calif.

[ * ] Notice: The portion of the term of this patent subsequent to Oct. 4, 2005 has been disclaimed.

[21] Appl. No.: 913,504

[22] Filed: Sep. 29, 1986

[51] Int. Cl.[4] ..... B22D 11/00

[52] U.S. Cl. ..... 164/436; 164/440; 164/443; 164/418

[58] Field of Search ..... 164/418, 435, 436, 440, 164/443, 444, 485, 486, 490, 491

[56] References Cited

U.S. PATENT DOCUMENTS 4,580,614 4/1986 Haissig ..... 164/414

FOREIGN PATENT DOCUMENTS 58-151944 9/1983 Japan ..... 164/436

*Primary Examiner*—Nicholas P. Godici
*Assistant Examiner*—Richard K. Seidel
*Attorney, Agent, or Firm*—Roy A. Ekstrand

[57] ABSTRACT

A short mold for use in a continuous casting system includes a short taperless casting die coupled to a plurality of cooling plates having means for circulation of coolant therethrough arranged in a serially overlapping configuration in which the plates are individually moveable to accommodate variations of the casting. Hydraulic means are operative upon the cooling plates to assert a contact force and hold the cooling plates in contact with the surfaces of the casting. The individual plate motions provide for accommodation of the taper of the cooling casting.

8 Claims, 2 Drawing Sheets

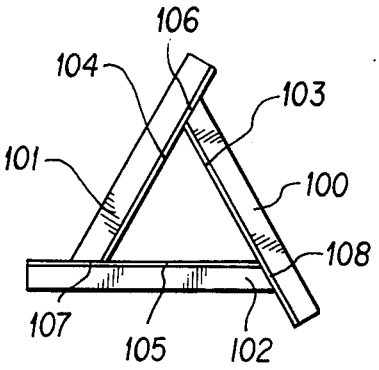
FIG 2C
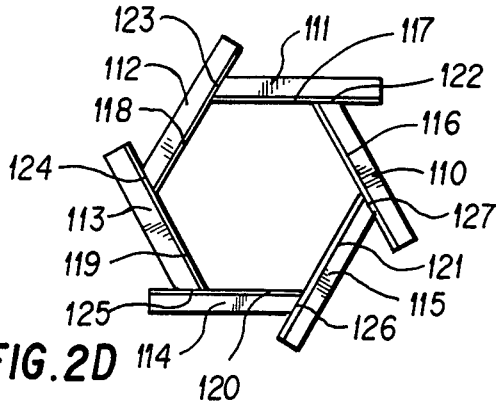
FIG. 2D
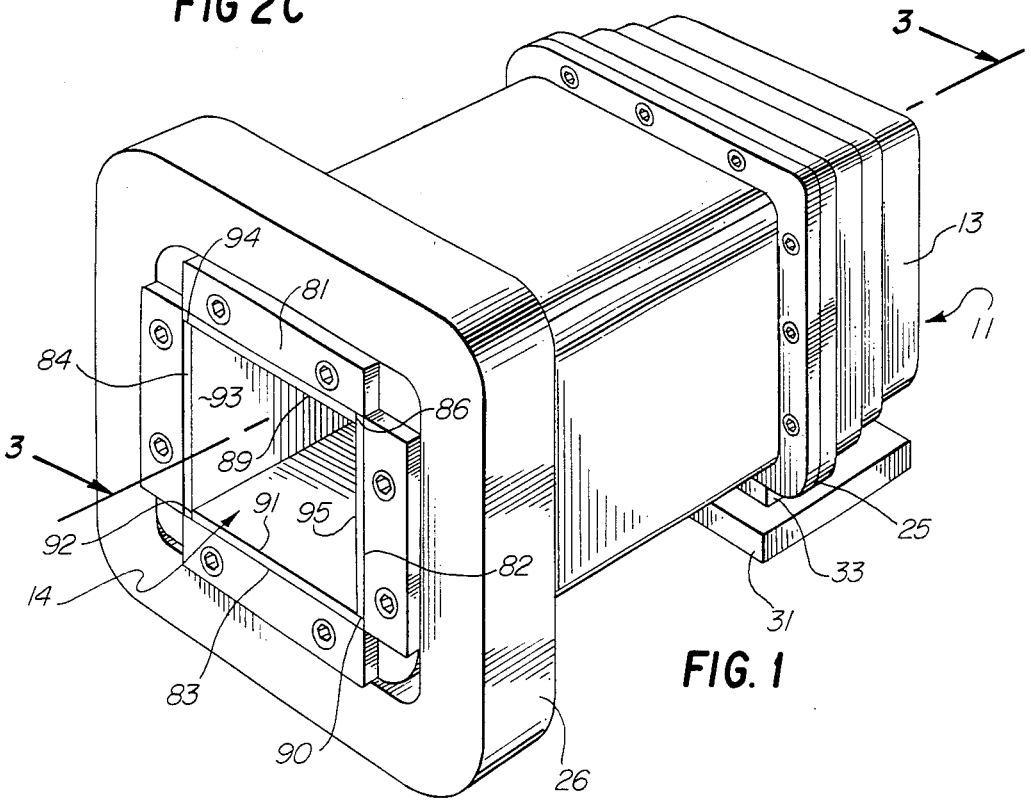
FIG. 1
FIG. 2A
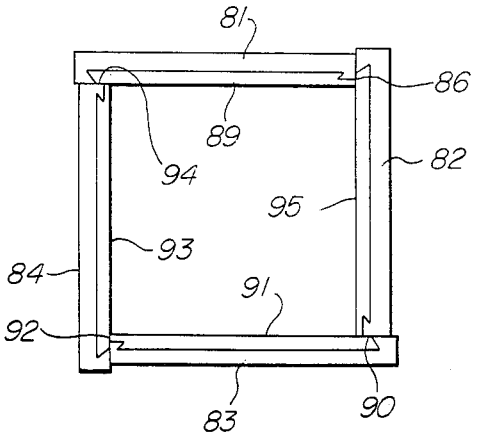
FIG. 2B
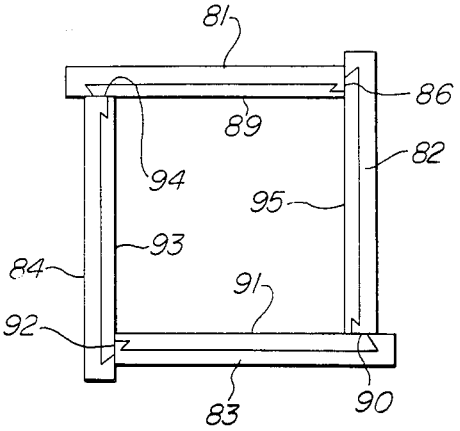

SHORT MOLD FOR CONTINUOUS CASTING

CROSS REFERENCE TO RELATED PATENT APPLICATIONS

This application discloses apparatus described and claimed in the following related applications, each of which is assigned to the assignee of this application:

1. Ser. No. 913,022, filed: Sept. 29, 1986 and entitled: Continuous Casting Extended Throat and Tail-heater.
2. Ser. No. 913,077, filed: Sept. 29, 1981 and entitled: Moving Plate Continuous Casting Aftercooler.

FIELD OF THE INVENTION

This invention relates generally to continuous casting systems in which a single elongated casting is formed and particularly to casting molds within horizontal continuous casting systems requiring substantial heat transferring capability.

BACKGROUND OF THE INVENTION

The continuous casting system provides a system of casting fabrication in which a supply of molten metal or metal alloy is heated and liquified within a furnace-like structure called a tundish or heated outside the tundish and placed therein prior to casting. In most systems, the furnace or tundish includes a discharge orifice near the bottom of its internal cavity which is coupled by a passage to a cooled die or mold. The latter defines an entrance opening and an exit opening and an elongated die passage suitable for the formation of an elongated casting. In addition, cooling means are provided which generally encircle or surround the die passage for the purpose of conducting sufficient heat from the molten metal within the die passage to solidify all or part of the molten metal therein and form the casting. Continuous casting systems may comprise either vertical or horizontal casters.

Vertical casting systems are generally used to form large plate-like castings and acquire their name from the vertical path which the casting travels. The furnace and cooled mold are arranged vertically and gravity flows the molten metal from the furnace into and through the mold. In most vertical casting systems, an array of drive rollers beneath the mold control the downward progression of the casting. In addition, many vertical casting systems include means which introduce a gradual curve into the casting to transition it from a vertical path to a horizontal path in order to reduce the overall height of the casting system.

The horizontal continuous casting process acquires its name from the horizontal arrangement of the tundish and cooled mold as well as the horizontal path which the casting travels. This provides a system in which a supply of molten metal is caused to flow horizontally to a cooled die which defines a horizontal elongated die passage in which an elongated casting is formed. The cross section of the cooled die passage determines the cross section of the continuously formed casting. Coolant is circulated through the cooled die to carry heat from the introduced molten metal with sufficient speed to cause the molten metal to solidify or freeze on at least its outer surfaces, that is the surfaces proximate to the die passage surfaces. A solidified peripheral region of the casting is thus formed which "grows" inwardly toward the core of the casting within the die passage as heat continues to be carried from the metal.

Generally, the length and capacity of the cooled die and speed of casting motion are selected to ensure that the casting emerging from the die passage is at least solidified about its outer surface and inward therefrom to a depth sufficient to permit the casting to be pulled by a pair of motor driven rollers downstream of the die passage. While the continuous casting process is generally described as a process in which the molten metal within the furnace is "continuously" flowed into the die passage from the casting, the actual casting motion is more "step-like" than continuous. That is to say the casting is periodically moved forward in a series of short steps of a predetermined distance called "strokes". Between strokes the casting is stopped for a brief time or in some systems a brief backspace of the casting occurs between forward strokes to reduce boundaries within the material. Thus the process is, in one sense, a misnomer in that the motion of the casting is not truly continuous, but rather, is periodically stopped and in some instances, reversed, for a brief "backstep". However, the process continues to be known in the art as continuous casting because it provides an emerging casting having virtually unlimited length and a cross sectional shape determined by and conforming to that of the die passage.

In both horizontal and vertical casting systems, the formation of thicker casting configurations results in withdrawing the casting from the cooled mold before complete solidification has taken place. As a result, the casting emerging from the cooled die passage has the above-described solidified outer skin and molten center. The heat present in the molten casting center can cause the casting skin of the casting emerging from the cooled die passage to be melted. Practitioners in the art have attempted to meet this problem, known as "remelting", by utilizing a cooled die or mold which is long enough to have sufficient cooling capacity to withdraw substantially more heat from the casting than the minimum required to form the above-described skin. Often such long molds have die passages with lengths equal to seven to ten casting strokes. The use of long casting molds provides some additional cooling of the casting. However, the effectiveness of long molds in the continuous casting process is limited due to the shrinkage which the casting undergoes as cooling takes place. This shrinkage tends to distribute itself down the casting and result in a reduced cross-sectional area and surface area of the casting as a function of distance from the tundish. In essence, the casting assumes a "tapered shape". In most castings, the casting taper is sufficient to cause an air space to be created between the casting skin and the surfaces of the cooled die passage as the casting "shrinks" away from the passage walls. Once the contact between the passage walls and the casting surface is broken, the cooling of that area of the casting is decreased reducing overall cooling and creating "hot spots" in the casting. It is the creation of these hot spots which may produce a localized remelting of the solidified casting causing molten metal from the casting interior to flow out beyond the casting skin and damaging the casting. Even if actual remelting is avoided, the portions of the casting remaining in contact with the die passage are cooled more rapidly than those no longer in contact. As a result, uneven cooling takes place which degrades casting quality and may actually cause the casting to warp or bend.

The problems associated with casting taper in long molds have prompted practitioners in the art to attempt to compensate for casting shrinkage by simply constructing the die passage of the long mold to include a carefully designed taper which gradually narrows the die passage as a function of distance from the entrance orifice or tundish.

The use of tapered die passages within the mold structures provides some improvement in the ability of the cooled die to compensate for the shrinkage of the casting. However, the determination of appropriate casting taper is complex and the use of a tapered mold involves careful control of the system operation. For example, each casting configuration and size and each metal or metal alloy used requires a different shrinkage taper. In addition, for each casting and metal or metal alloy cast, the passage taper is fitted to a casting stroke and speed. Therefore, the casting stroke and speed must be inordinately controlled. Simply stated, the mold or cooled die taper must be customized for each application. This leads to increased fabrication and tooling costs which are prohibitive in a competitive environment. Further, tapered molds or dies are less tolerant of wear due to the precision required of the taper. Such systems, as shown and described in U.S. Pat. No. 3,580,327, U.S. Pat. No. 4,308,774, and U.S. Pat. No. 3,467,168, provide structures which contact only portions of the casting surface. As is well understood by those skilled in the casting art, complete contact with the entire casting surface including its corners is essential to the attainment of even cooling of the entire casting in order to provide the desired casting uniformity and grain structure as well as prevention of the remelt phenomenon.

While the above-described prior art long mold casting structures have provided some improvement in casting cooling and a partial solution to the problem of accommodating casting tapers, they are subject to the above-described problems of accommodating casting taper. There remains therefore, a need in the art for an improved cooled mold for use in continuous casting systems which effectively withdraws heat from the emerging casting and which avoids the need to utilize a custom tapered long mold structure.

SUMMARY OF THE INVENTION

Accordingly, it is a general object of the present invention to provide an improved cooled mold for use in the continous casting process. It is a more particular object of the present invention to provide an improved cooled mold for use in the continuous casting process which cools the entire outer surface of the casting and the cooling surfaces of despite shrinkage and taper of the casting. It is a still further object of the present invention to provide an improved cooled mold for use in a continuous casting system which accommodates a broad range of casting tapers.

In accordance with the present invention, there is provided a cooled mold adapted to receive and cool a continuously formed casting of metal or metal alloy having a short cooled die passage and a plurality of moveable cooling plates are arranged to form an extension of the die passage through which the casting passes as it emerges from the short cooled die passage. Each of the plates accommodates a cooling apparatus for removing heat from the casting. The moveable plates are so arranged relative to each other as to permit them to move relative to each other to alter the cross-sectional size of the passage way defined by the interiors of such plates and thereby maintain contact with all portions of the periphery of the casting and compensate for any shrinkage thereof. Means are provided which are operative upon the plates to apply a predetermined inward force thereto and cause the plates to be biased into engagement with the underlying portion of the periphery of the casting.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 is a perspective view of a short mold for a continuous casting system having a moving plate recooler constructed in accordance with the present invention;

FIGS. 2A and 2B are section views of the present invention short mold and recooler taken along section lines 2—2 in FIG. 1;

FIG. 2C is a section view of a triangular embodiment of the present invention short mold and moving plate recooler;

FIG. 2D is a section view of a hexagonal embodiment of the present invention short mold and moving plate recooler;

DESCRIPTION OF THE PREFERRED EMBODIMENT

Figure 3:
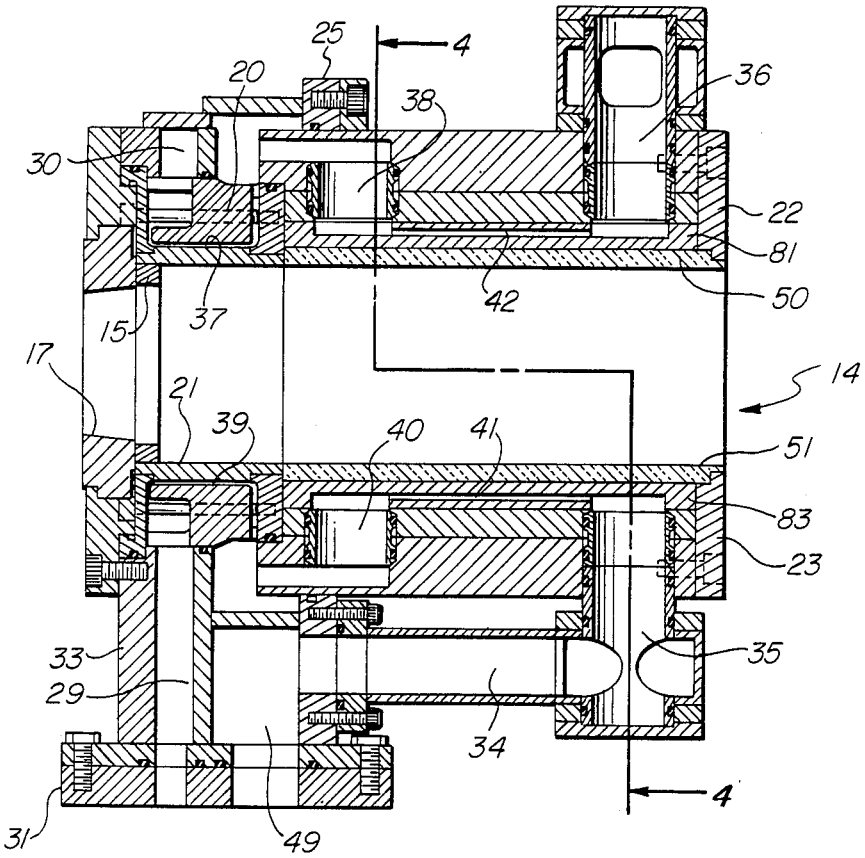
FIG. 3 is a section view of the present invention short mold and recooler taken along section lines 3—3 in FIG. 1.

FIG. 1 sets forth a perspective view of a short mold and recooler for a horizontal continuous casting system constructed in accordance with the present invention and generally referenced by the numeral 10 having an imput end 11 which is intended to be sealing coupled to a tundish (not shown) which provides a source of molten metal for use in the casting process. While not shown in FIG. 1 it should be noted that in accordance with standard horizontal continuous casting methods, a slide gate is utilized in most applications to couple short mold 10 to the tundish and provide an operable passage which, when opened, permits molten metal within the tundish to flow through the slide gate and commence the casting process.

During the casting process itself, slide gate 15 is maintained in the open position to permit a substantially continuous flow of molten metal from the interior of the tundish into mold 10.

Shortmold 10 comprises a pair of support frames 25 and 26 which are substantially parallel and spaced apart from each other which encircled a cooling die 13 and a moving plate recooler 12 coupled together to form a continuous casting and cooling passage. A base member 31 is secured to frame 25 by frame attachment 33. In its normal installation in a horizontal continuous casting system, base member 31 is secured to a casting bed having a support surface to maintain the position of mold 10. A plurality of cooling plates 81, 82, 83 and 84 are secured to and supported by frames 25 and 26 by means described below in greater detail. It should be understood that while short mold 10 includes, in the embodiment shown, a plate recooler 12 having a total of four cooling plates, virtually any number of plates may be used to produce castings having a different arrangement of facets. For example, three plates may be combined to form a triangular casting and five plates to form a pentagonal casting and so on.

By means set forth below in greater detail, hydraulic means (better seen in FIG. 3) are operative upon the cooling plates of recooler 12, to maintain cooling plate contact with the forming casting within the internal casting passage of cooling die 13.

In the typical operation of the present invention short mold, molten metal within the interior of the tundish is caused to flow through a slide gate and into cooled casting die 13. Within casting die 13, the initial cooling of the exterior surfaces of the forming casting is carried forward in accordance with conventional continuous casting processes. In further accordance with such continuous casting processes, a solidified skin forms upon the casting exterior surfaces in contact with the interior of casting die 13 and is further cooled by plate recooler 12. The forming casting thereafter passes through recooler passage 14 of recooler 12 and emerges as a partially solidified casting. Because of the above-described molten center which the casting retains as it exits recooler passage 14, a series of additional cooling devices are generally coupled to recooler passage 14 to further cool the emerging casting. It should be apparent that while the aftercoolers described in the above-referenced copending application entitled "Moving Plate Continuous Casting Aftercooler" may be utilized with short mold 10, other aftercoolers may be used without departing from the spirit and scope of the present invention.

In accordance with an important aspect of the present invention, and by means set forth below in greater detail, plate recooler 12 of short mold 10 is operative upon the casting within recooler passage 14 to maintain contact between the outer surfaces of the casting and the recooler plates. As described below, cooling plates 81, 82, 83, and 84 adjust for shrinkage and other changes such as taper which the casting undergoes. It should also be noted that unlike the above-described prior art systems casting die 13 is approximately three or four casting strokes in length which in accordance with an important aspect of the present invention permits the use of a casting die formed with a tapered passage.

It should also be noted that the perspective view shown in FIG. 1 is a simplified embodiment of the present invention short mold configured to receive a square or rectangular cross sectioned casting in which several operative components of the structure have been omitted to facilitate description of the cooperation between cooling plates 81 through 84. As is shown in FIG. 3 below, a plurality of hydraulic actuators are operative upon the present invention moving plate recooler to move cooling plates 81 through 84 in order to adjust for casting taper. Accordingly, it should be understood that FIG. 1 is set forth primarily to illustrate the operative principles of the present invention and does not therefore attempt to disclose a detailed operative structure. A cooling plate 81 comprises a substantially planar rectangular plate member defining an interior cooling surface 89 and a precision machined plate edge 86 extending for the entire length of cooling plate 81. A cooling plate 82 comprises a substantially rectangular flat plate defining a flat interior cooling surface 95 and a machined plate edge 90 extending its entire length. A cooling plate 83 comprises a substantially rectangular flat plate defining a flat interior cooling surface 91 and a machined plate edge 92 extending its entire length. A cooling plate 84 comprises a substantially rectangular flat plate defining a cooling surface 93 and a precision machined plate edge 94 extending its entire length. Cooling plates 81 through 84 are arranged such that cooling surfaces 89, 95, 91 and 93 are all inwardly facing to surround a recooler passage 14. In addition, cooling plates 81 through 84 are arranged to form a rectangular casting passage in that cooling plate 81 is mutually perpendicular to cooling plates 84 and 82 and is parallel to cooling plate 83. Accordingly, the intersection of plates 81 and 82 at plate edge 86 forms a right angle. Similarly, the intersection of plates 82 and 83 at plate edge 90 form a right angle and cooling plate 83 forms a right angle with cooling plate 84 while cooling plate 84 forms a right angle with cooling plate 81. It will be apparent however, that different angles between the cooling plates are used if the casting is formed in a different shape such as triangular or pentagonal.

A frame 26 encircles cooling plates 81 through 84 and supports a quartet of hydraulic cylinders (not shown) each positioned overlying cooling plates 81, 82, 83 and 84 respectively. A second frame 25 is spaced from frame 26 and encircles cooling plates 81 through 84. Frame 25 supports cooling plates 81 through 84 in a special relationship corresponding to the size of the casting emerging from casting die 13. In accordance with an important aspect of the present invention, the hydraulic cylinders operative upon the end of cooling plates 81 through 84 respectively proximate to frame 26 to adjust the taper of recooler passage 14 to conform to that of the casting within the passage. While the embodiment shown supports the end of plates 81 through 84 beneath frame 25 in a fixed relationship, both ends of the cooling plates may be moveable if desired. Accordingly, as will be described below in greater detail, the taper of the cross-section of recooler passage 14 may be adjusted such that each machined plate edge 86 and cooling surface it abuts are fabricated to produce a seal therebetween notwithstanding motion of the plate edge 86 with respect to the cooling surface. Accordingly, plate edges 86, 90, 92 and 94 and cooling surfaces 95, 91, 93 and 89 form respective sealing contacts to seal recooler passage 14.

FIGS. 2A and 2B illustrate the accommodation of casting size variations of the present invention short mold recooler. Turning FIG. 2A, it should be noted that cooling plate 81 extends beyond plate edge 94, while cooling plate 82 extends beyond plate edge 86, and cooling plates 83 and 84 extend beyond plate edges 90 and 92 respectively. The position shown in FIG. 2A therefore, is representative of an inward accommodation of the present invention recooler such as would take place to maintain cooling plate contact with a casting of reduced size. Such as occurs for example in the above-described casting shrinkage during cooling. Conversely, FIG. 2B shows the position of cooling plates 81 through 84 as they appear when the present invention recooler has been forced to expand to accommodate a larger cross-section casting. It should be apparent to those skilled in the art that the size represented in FIGS. 2A and 2B is for illustration only and not indicative of actual casting shrinkage. Comparison of FIGS. 2A and 2B shows that recooler passage 14 is substantially reduced in FIG. 2A and substantially increased in FIG. 2B. In accordance with an important aspect of the present invention, it should be noted that, notwithstanding the substantial size accommodation represented by the positions of cooling plates 81 through 84 in FIGS. 2A and 2B, the contact of plate edges 86, 90, 92, and 94 with cooling surfaces 95, 91, 93, and 89 respectively is maintained.

With simultaneous reference to FIGS. 1 and 2A and 2B, it should be noted that in accordance with an important aspect of the present invention, each of cooling plates 81 through 84 is moveable under the action of the hydraulic cylinders of the present invention recooler without disturbing the integrity of recooler passage 14. For example, cooling plate 81 may be moved inwardly without interfering with the integrity of recooler passage 14 because plate edge 86 is a precision edge and therefore maintains its sealing contact with the flat cooling surface 95 as cooling plate 81 is moved inwardly. Correspondingly, inward motion of cooling plate 81 forces cooling plate 84 to move downwardly, which in turn moves cooling surface 93 with respect to plate edge 92 of cooling plate 83. In the same manner described for plate edge 86 and cooling surface 95, the motion of cooling plate 84 with respect to cooling plate 83 does not disturb the sealing contact of plate edge 92 as it moves across cooling surface 93. In other words, when cooling plate 81 is driven inwardly cooling plate 84 moves downwardly, which in turn moves plate edge 86 with respect to cooling surface 95 and plate edge 92 with respect to cooling surface. Because of the precision fit of the cooling surfaces and plate edge, a sealing abutment is maintained between each plate edge and its respective cooling surface notwithstanding the relative motion of any of the plates. In addition, it should be noted that inward motion of cooling plate 81 which or reduce casting passage 85, also apply a force to plate edge 94 which increases the contact pressure between cooling surface 89 and plate edge 94 of cooling plate 84. Similarly, the inward motion of cooling plate 82 moves plate edge 90 across cooling surface 91 and drives cooling plate 81 to the left in FIG. 2A. In similarity to the motion of cooling plate 81, the inward movement of cooling plate 82 causes an increase in the contact pressure between cooling surface 95 and plate edge 86. The precision machining of cooling surface 91 and plate edge 90 ensures that the motion of plate edge 90 across cooling surface 91 does not disturb the sealing contact therebetween and the integrity of recooler passage 14 is maintained. By further example, motion of cooling plate 83 in the inward direction (that is upward in FIG. 2A) further contracts or reduces recooler passage 14. The inward motion of cooling plate 83 also moves plate edge 92 across cooling surface 93 with the contact therebetween being maintained as described for cooling plates 81 and 82. In further similarity to the above-described plate motion, the inward motion of plate 83 forces cooling plate 82 upward in FIG. 2A. Finally, the reduction of cross-section of recooler passage 14 is completed by an inward force supplied by hydraulic cylinder 80 against cooling plate 84 causing cooling plate 84 to be moved inwardly, moving plate edge 94 with respect to cooling surface 89 and moving cooling plate 83 to the right in FIG. 2A.

As will be apparent from the foregoing discussion, the reduction of recooler passage 14 by inward motion of cooling plates 81 through 84 is accomplished without disturbing the sealing contact between the plate edges and the cooling surfaces of the structure. Conversely, and with reference to FIG. 2B, the area of recooler passage 14 may be increased in the reverse manner to a maximum cross-section area such as the situation depicted in FIG. 2B. By reference to FIGS. 2A and 2B, it should be noted that notwithstanding the substantial difference in recooler passage 14 depicted in FIGS. 2A and 2B, the sealing engagements of plate edges 86, 90, 92 and 94 with cooling surfaces 95, 91, 93 and 89 respectively, is maintained.

While the foregoing discussions assume simultaneous motion of cooling plates 81 through 84 has occured, it should be apparent to those skilled in the art that the inward motion of each of plates 81 through 84 may be independently undertaken. As a result, and in accordance with an important aspect of the present invention, the motion of cooling plates 81 through 84 may accommodate not only changes in casting cross-sectional area, but also accommodate nonuniformites of the casting which result in bending or twisting of the casting. In other words, if for example, the casting passing through recooler passage 14 acquires a slight curvature causing it to shift to the left in FIG. 2A, cooling plate 84 will be moved to the left in response to the force applied by the casting. At some point this force will be balanced by the opposite side hydraulic cylinder and the casting surface will contact cooling plate 84. In further response to the curvature and leftward motion of the casting, cooling plate 82, moves to the left direction until cooling surface 95 is brought into contact with the underlying surface of the casting. As a result, the shift of the casting within recooler passage 14 to the left, due to curvature of the casting, is compensated for by the motions of cooling plates 82 and 84.

The above-described motion of cooling plates 81 through 84 are particularly suited to adjusting for the above-described taper of the casting as it cools. With particular reference to FIGS. 1, 2A and 2B, it should be noted that because plate edges 86, 90, 92 and 94 maintain their respective sealing contacts with cooling surfaces, 95, 91, 93 and 89 regardless of the relative motion therebetween, it should be apparent to those skilled in the art that the cooling plates 81 through 84 which produce an inclination of one or more of the cooling plates do not disturb that seal. For example, in the event inward deflection of the ends of cooling plates 81 through 84 proximate frame 26 cause each cooling plate to be inwardly inclined such that the cross-sectional area of recooler passage 14 at the end proximate to frame 26 is substantially reduced with respect to the other end. In other words, recooler passage 14 becomes tapered from a larger cross-section area proximate frame 25 to a reduced cross-section area proximate frame 26. In accordance with an important aspect of the present invention, the ability of the recooler of the present invention to provide an adjustable tapered casting passage permits the contact between the cooling surfaces of each cooling plate and the underlying surfaces of the casting to be maintained over the entire area and most importantly, at the corners of the casting surface.

While the example set forth in FIGS. 1, 2A and 2B is that of a square cross-sectional casting, it will be apparent to those skilled in the art that the present invention may be applied to numerous multi-faceted casting configurations such as triangular, rectangular, pentagonal, hexagonal and so on. In addition, it will be equally apparent to those skilled in the art that the present invention is not limited to castings having symetrical cross-sections but may be adapted to cool castings having irregular cross-sectional shapes.

Accordingly, FIG. 2C sets forth a triangular embodiment of the present invention aftercooler in which a trio of cooling plates 100, 101 and 102 are arranged to define a triangular central passage and support a corresponding trio of cooling surfaces 103, 104 and 105 respectively. Cooling plate 100 defines a sealing edge 106, cooling plate 101 defines a sealing edge 107 and cooling plate 102 defines a sealing edge 108.

FIG. 2D sets forth a hexagonal embodiment of the present invention aftercooler in which six cooling plates 110, 111, 112, 113, 114 and 115 support respective cooling surfaces 116, 117, 118, 119, 120 and 121 and define a hexagonal interior passage. Cooling plates 110 through 115 define respective sealing edges 122 through 127.

The embodiments set forth in FIGS. 2C and 2D function in the same operative manner as the rectangular embodiment shown in FIGS. 2A and 2B.

Figure 4:
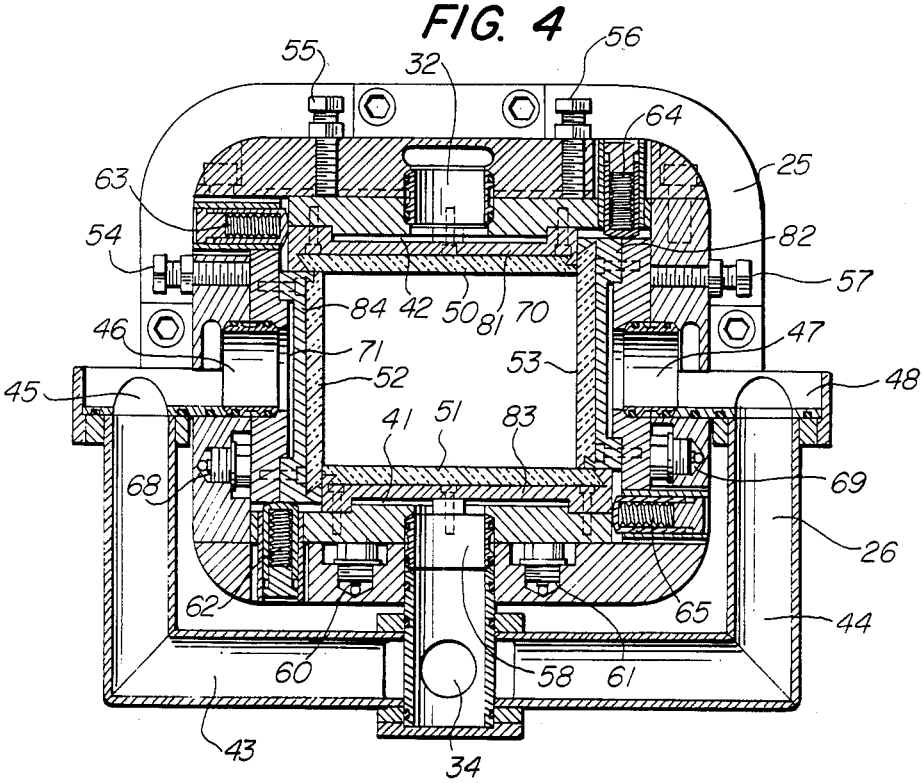
FIG. 4 is a section view of the present invention short mold and moving plate recooler taken along section lines 4—4 in FIG. 3.

FIGS. 3 and 4 set forth section views of the present invention short mold and recooler taken along section lines 3—3 in FIG. 1 and section lines 4—4 in FIG. 3 respectively. With simultaneous reference to FIGS. 3 and 4, the present invention short mold and recooler comprises a casting die 13 comprising a fixed dimension passage of copper material defining an interior casting passage 21 and a plurality of cooling passages 37 and 39. A ceramic brake ring 15 comprises an annular ceramic member situated at the entrance opening of casting passage 21. A ceramic nozzle 16 having a generally tapered interior passage 17 is attached to casting die 13 in a fixed relationship. Casting die 13 is coupled to a support 25 which secures recooler 12 to casting die 13 by conventional fasteners such that recooler passage 14 and casting passage 21 are in substantial alignment. As set forth above, recooler 12 comprises a quartet of overlapping cooling plates 81 through 84 respectively which are configured in the edge to surface serial relationship set forth in FIG. 1. In addition, FIGS. 3 and 4 show the structure of cooling plates 81 through 84 in greater detail in that cooling plate 81 defines a graphite layer 50, cooling plate 82 defines a graphite layer 53, cooling plate 83 defines a graphite layer 51 and cooling plate 84 defines a graphite layer 52. In accordance with the inventive structure, graphite plates 50 through 53 form the entire interior surface of recooler passage 14 and serve to contact the casting passing therethrough. As is best seen in FIG. 3, cooling plates 81 through 84 further define a quartet of plate caps 22 and 23 on cooling plates 81 and 83 respectively. In addition, cooling plates 82 and 84 define similarly configured plate caps 27 and 28 respectively (not seen in FIGS. 3 and 4). In accordance with the present invention, cooling is provided to casting die 13 by a supply of coolant through cooling passages 29 and 30. A fluid guide 20 is situated within cooling passages 29 and 30 and extends about the exterior of casting passage 21 and is spaced therefrom by a predetermined distance to provide a cooling passage 37 and a cooling passage 39 encircling casting passage 21 of casting die 13. In accordance with generally accepted continuous casting techniques, coolant is pumped through cooling passages 29 and 30 and traverses the cooling passages surrounding casting die 13 to withdraw sufficient heat from casting passage 21 to solidify the outer skin of the casting formed therein. It should be noted by those skilled in the art that the length from ceramic ring 15 to the entrance to recooler passage 14 is substantially shorter than casting molds of the prior art configuration. That is to say, casting passage 21 has a substantially short casting passage length. In accordance with an important aspect of the present invention, casting passage 21 is not tapered and need not, due to its short structure, accommodate the taper of the casting forming therein. Casting passage 21 is short in terms of the number of casting strokes which comprise its length, typically three or four casting strokes. Plate recooler 12 includes a recooler passage 14 which, as mentioned, is substantially continuous with casting passage 21 and which receives the casting formed therein and in accordance with the present invention, cools the outer surface of the casting. A coolant passage 49 is coupled to a source of coolant and to a plurality of cooling passages 34, 38, 35 and 36 which cooperate to circulate coolant through cooling passages within cooling plates 81 through 84.

With particular attention to FIG. 4, it should be noted that cooling passages 32, 47, 58 and 46 comprise structures which accommodate the relative motions of cooling plates 81 through 84 and provide sealing engagement therewith to couple the supplied coolant circulating through cooling passages 34, 43, 44, 48 and 45 to direct the supply of coolant through cooling passages 41 and 42 adjacent cooling plates 83 and 81 respectively as well as cooling passages 70 and 71 adjacent cooling plates 82 and 84 respectively. The resulting structure comprises the above-described quartet of cooling plates together with a plurality of adjacent cooling passages 41, 42, 70 and 71 which function to supply coolant to plates 81 through 84 and to remove additional heat from the casting within casting passage 14.

In accordance with the invention, frame 26 defines a plurality of hydraulic cylinders supported therein which are operative upon cooling plates 81 through 84. By way of example, and with reference to FIG. 4, a pair of hydraulic cylinders 60 and 61, coupled to a source of hydraulic fluid under pressure, are positioned within frame 26 and maintained in contact with cooling plate 83. In response to introduced pressure, hydraulic cylinders 60 and 61 expand to drive cooling plate 83 inward (that is upward in FIG. 4) in order to reduce the size of recooler passage 14. A similar set of hydraulic cylinders are situated adjacent each of the remaining cooling plates 81, 82, and 84 which are not seen due to the section line offset in FIG. 4. However, it should be noted that the configuration of hydraulic cylinders adjacent cooling plates 81, 82 and 84 is substantially the same as that set forth for hydraulic cylinders 60 and 61 in proximity to cooling plate 83.

In addition to hydraulic cylinders operative upon coolings plates 81 through 84, such as hydraulic cylinders 60 and 61 for cooling plate 83, a plurality of tension springs 62, 63, 64 and 65 are supported within plate recooler 12 and are operative to bias cooling plates 81 through 84 to an open or withdrawn position in which the cooling plates define the maximum size recooler passage. Under the activation of hydraulic cylinders, this tension spring force is overcome and plates 81 through 84 are forced into contact with the casting being cooled within recooler passage 14. A plurality of adjustable threaded stops 54, 55, 56 and 57 are positioned near frame 25 and are operative to provide an outward extension travel limit for cooling plates 81 through 84 in the region of frame 25. It should be understood that a similar plurality of four additional stops are symetrically positioned on the lower portion of the present invention recooler but are not visible due to the offset of section line 4—4 in FIG. 3. The combined function of stops 54 through 47, as well as the unseen additional four stops positioned so as to be operative upon plates 84, 82 and 83, is to determine the outward extension of the plate motion and to limit it to the casting gage size. Thereafter, the operation of the plate recooler as described above, utilizes hydraulic cylinders situated within frame 26 to adjust the resulting taper of casting passage 14 by inclining cooling plates 81 through 84.

Because graphite plates 50 through 53 are moveably secured to cooling plates 81 through 84, plate caps 22, 23, 27 and 28 are utilized to secure the graphite plates within recooler passage 14. It will be apparent to those skilled in the art however that in the alternative graphite plates 50 through 53 may be otherwise secured to cooling plates 81 through 84 without departing from the spirit and scope of the present invention.

What has been shown is a short mold for continuous casting in which a copper casting die, having a length of approximately three or four casting strokes and having a substantially straight, taperless casting passage, is utilized in combination with a moving plate recooler having a plate configuration which permits substantially improved cooling of the entire surface of the casting and which accommodates the taper of the cooling casting.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A short mold for use in forming and cooling a continuously cast elongated metal casting, said short mold comprising:

a cooled casting die defining a taperless internal casting passage and a first plurality of cooling passages;

a plurality of interengaging walls, having inwardly facing cooling surfaces, which cooperate to form a passageway through which said metal casting passes and which are arranged to engage the periphery of said metal casting, each of said walls defining a second plurality of cooling passages in a heat transfer relationship with said cooling surfaces of said walls, said walls being supported so as to permit said walls to move relative to each other to adjust the cross-sectional size of said passageway so as to maintain contact between all portions of the periphery of said metal casting and said cooling surfaces of said walls and thereby compensate for shrinkage of said metal casting as it cools;

each of said interengaging walls defining a first end having a sealing edge configured to sealingly contact the cooling surface of the adjacent wall thereto and a second end wherein said walls are arranged relative to each other such that the sealing edge of each wall contacts the cooling surface of a first adjacent wall on one side through the abutment of its sealing edge with the cooling surface of such first adjacent wall and contacts a second adjacent wall on the other side by the abutment of its cooling surface with the sealing edge of said second adjacent wall;

cooling means for circulating a cooling fluid through said first and second plurality of cooling passages; and force means for causing said walls to be moved inwardly to contact said casting and to maintain contact with the entire periphery of said metal casting as it passes through said passageway.

2. A short mold as set forth in claim 1 wherein said metal casting defines a polyhedron having a plurality of planar exterior surfaces and wherein said casting passage defines a corresponding polyhedron and wherein said plurality of walls correspond in number and arrangement to said exterior surfaces and each of said cooling surfaces is maintained in contact with one of said exterior surfaces.

3. A short mold as set forth in claim 2 wherein said metal casting and said casting passage define a rectangular cross-section and wherein said plurality of walls define four walls and said passageway defines a rectangular cross-section corresponding to said rectangular casting.

4. A short mold as set forth in claim 2 wherein said metal casting and said casting passage define a triangular cross-section and wherein said plurality of walls define three walls and said passageway defines a triangular cross-section corresponding to said triangular casting.

5. A short mold as set forth in claim 2 wherein said metal casting and said casting passage define a hexagonal cross-section and wherein said plurality of walls define six walls and said passageway defines a hexagonal cross-section corresponding to said hexagonal casting.

6. A short mold as set forth in claim 2 wherein said walls each define first and second ends and wherein said force means include:

means establishing a fixed position for said first ends of said walls;

a first plurality of hydraulic cylinders operative upon said second ends of said walls; and means for causing said first plurality of hydraulic cylinders to move said first ends of said walls inwardly a greater distance than said second ends of said walls and cause said passageway to assume a taper.

7. A short mold as set forth in claim 6 further including spring means coupled to and operative upon said walls to urge said walls outwardly to tend to expand said passageway and wherein said force means are operative to overcome said urging of said spring means.

8. For use in a continuous casting system in which an elongated metal casting is formed within a cooled mold and emerges therefrom having a solidified outer skin and a molten interior, a short mold comprising:

a casting die defining a taperless internal casting passage;

a plurality of moveable walls, encircling said elongated casting coupled to said casting die, each defining a cooling surface and having a first end having a sealing edge configured to sealingly contact the cooling surface of an adjacent wall thereto and a second end, said walls being arranged relative to each other such that each wall contacts a first adjacent wall on one side through the abutment of its sealing edge with the cooling surface of such first adjacent wall and contacts a second adjacent wall on the other side through the abutment of its cooling surface with the sealing edge of said second adjacent wall;

means for cooling said casting die;

means for cooling said walls; and means for forcing said walls inwardly against said elongated casting.

* * * * *